US005518076A

United States Patent [19]

Holz et al.

[11] Patent Number: 5,518,076

[45] Date of Patent: May 21, 1996

[54] GREASE APPLICATOR FOR A DRILL SHAFT

[76] Inventors: John F. Holz, 7701 W. Winston Way, Franklin, Wis. 53132; Ronald C. Klassen, 1385 Crescent Dr., Elm Grove, Wis. 53122

[21] Appl. No.: 274,674

[22] Filed: Jul. 13, 1994

[51] Int. Cl.[6] ..... E21B 19/16; F01M 1/00

[52] U.S. Cl. ..... 175/57; 29/458; 166/243; 175/424; 184/14

[58] Field of Search ..... 166/243, 90, 75.1; 175/57, 424; 29/458; 118/DIG. 11; 184/105.3, 14

[56] References Cited

U.S. PATENT DOCUMENTS

| | | | |
|---|---|---|---|
| 2,246,874 | 6/1941 | Burge et al. | 222/108 |
| 2,642,034 | 6/1953 | Griffin et al. | 118/317 |
| 2,760,585 | 8/1956 | Bergeron | 166/243 |
| 3,475,781 | 11/1969 | Grant | 175/84 X |
| 4,199,858 | 4/1980 | Meijs | 166/243 X |
| 4,895,205 | 1/1990 | Thompson et al. | 166/90 |

*Primary Examiner*—Hoang C. Dang
*Attorney, Agent, or Firm*—Richard C. Ruppin

[57] ABSTRACT

A grease applicator for the threaded joint section of a drill shaft of a blasthole drill. The grease applicator has a grease applicator head movable to an application position adjacent the threaded section of the drill shaft by an applicator drive. The drive extends the applicator head to and extracts the applicator head from the application position. When the applicator head is at the application position, a propelling device for moving grease through the applicator head into engagement with the threaded section is activated to apply the grease to the threaded section. To distribute the grease over the threaded section, the applicator head may have a shape partially surrounding the threaded section. The threaded joint section is vertically positioned in the path of movement of the grease applicator head and the applicator head is extended by the applicator drive along a path toward the threaded section. After grease is propelled through the applicator head into engagement with the threaded section, the grease applicator head is retracted away from the threaded section along the path by the applicator drive.

10 Claims, 4 Drawing Sheets

GREASE APPLICATOR FOR A DRILL SHAFT

FIELD OF THE INVENTION

This invention relates to the application of grease to the threaded connector of a drill shaft and, more particularly, to an apparatus and method for applying grease to the threaded connector portion of a blasthole drill shaft without direct participation by the drill operator.

BACKGROUND OF THE INVENTION

In open-cast mining operations, it is often necessary to loosen overburden and the material to be mined to enable large power shovels and draglines to remove the overburden and mined material. The loosening work is best accomplished by the use of explosives placed at substantial depths in the overburden and material being mined.

Blasthole drills are used to drill into the overburden and material to be mined to the necessary depths to provide holes in which the explosives are placed. Drilling is often through hard rock, under very dirty conditions, and sometimes in very cold weather, making the work quite unpleasant. In order to reach the necessary depths at which the explosives must be placed, at least several and often a considerable string of drill shafts must be joined together at threaded joints as the drilling moves downward. When drilling is completed or if problems occur, the string of drill shafts must be raised and disassembled in a step-by-step manner. Due to drilling through hard material, the joining of the drill shafts together as drilling progresses downwardly, must be particularly tight. The continuous presence of dirt on the shafts and often the cold operating temperatures will also result in the joint being very tight. As a consequence, the disconnecting of each drilled shaft from another may be quite difficult. To assist with the problem of breaking joints when disconnecting drill shafts, before the shafts are threaded together at each joint, the drill operator is required to swab the exposed threaded joint with grease using a bucket of grease and a wire brush. However, operators do not consistently apply the grease due to factors such as poor weather conditions and a desire to hurry the work along. Lost production results due to later difficulty in breaking of the joints and damage to some threaded joints.

SUMMARY OF THE INVENTION

It is a general object of the present invention to provide an apparatus and method for applying grease to the connecting threaded joint section of a drill shaft prior to connecting the drill shaft to another drill shaft without the drill operator directly participating.

The invention is carried out on a blasthole drill using drill shafts each having threaded joint sections for connecting adjacent shafts together as the shafts are lowered into the ground or raised from the ground during a drilling operation. The blasthole drill includes a vertically movable carriage for raising and lowering the drill shaft and a rotary drive for rotating the drill shaft. A grease applicator is provided and includes a grease applicator head movable to an application position adjacent the threaded section of a drill shaft by an applicator drive means. The drive means extends the applicator head to and retracts the applicator head from the application position. When the applicator head is at the application position, propelling means for moving grease through the applicator head into engagement with the threaded section is activated to apply the grease to the threaded section. To distribute the grease over the threaded section, the applicator head may have a shape partially surrounding the threaded section. The threaded joint section is vertically positioned in the path of movement of the grease applicator head and the applicator head is extended by the drive means along a path toward the threaded section. After grease is propelled through the applicator head into engagement with the threaded section, the grease applicator head is retracted away from the threaded section along the path by the drive means.

BRIEF DESCRIPTION OF THE DRAWINGS

Other features of the present invention will be more clearly understood from the following detailed description of the preferred embodiment of the invention when read in conjunction with the accompanying drawings wherein.

DETAILED DESCRIPTION OF THE PREFERRED EMBODIMENT

Figure 1:
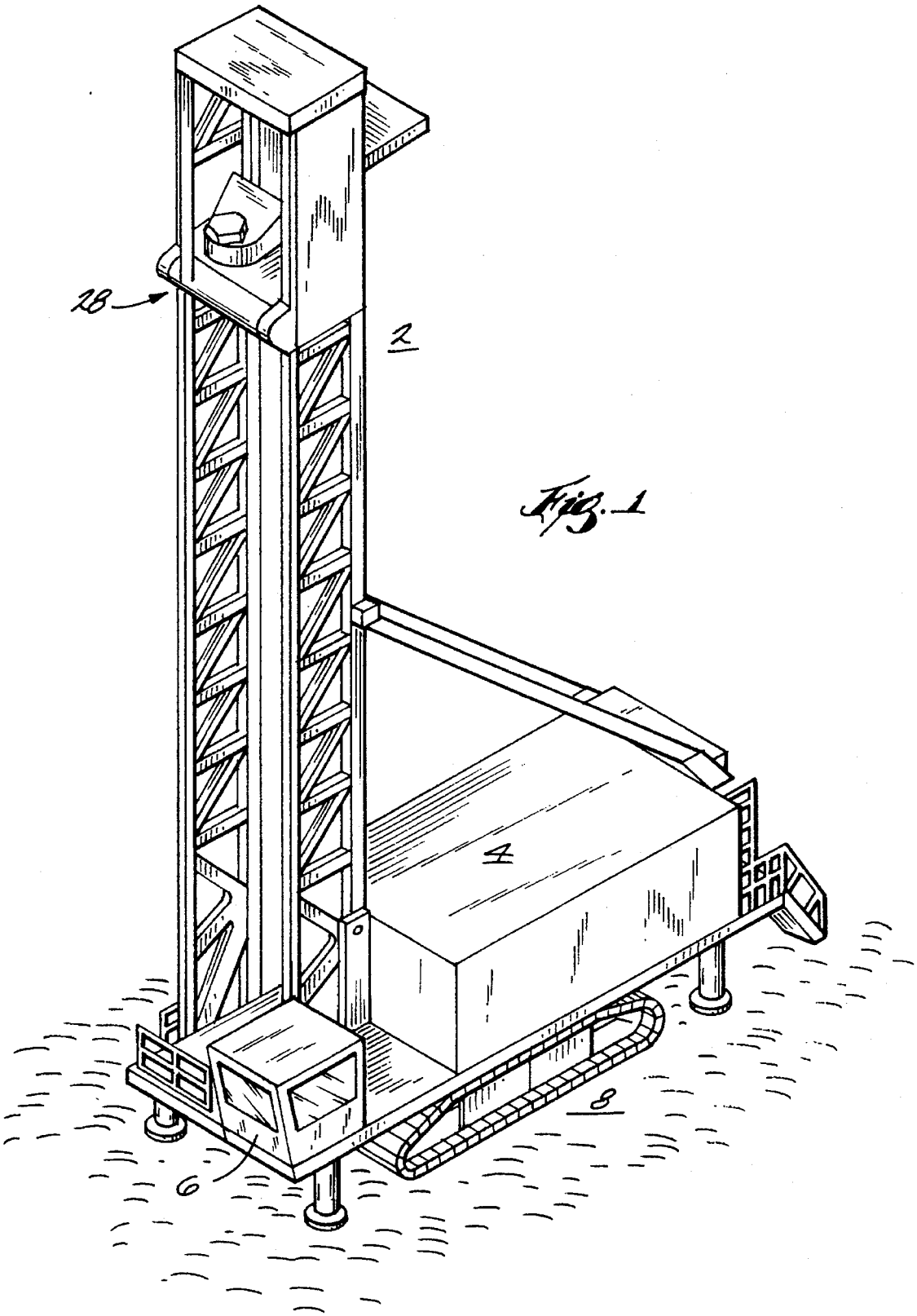
FIG. 1 is a perspective view of a blasthole drill incorporating the present invention.
Figure 2:
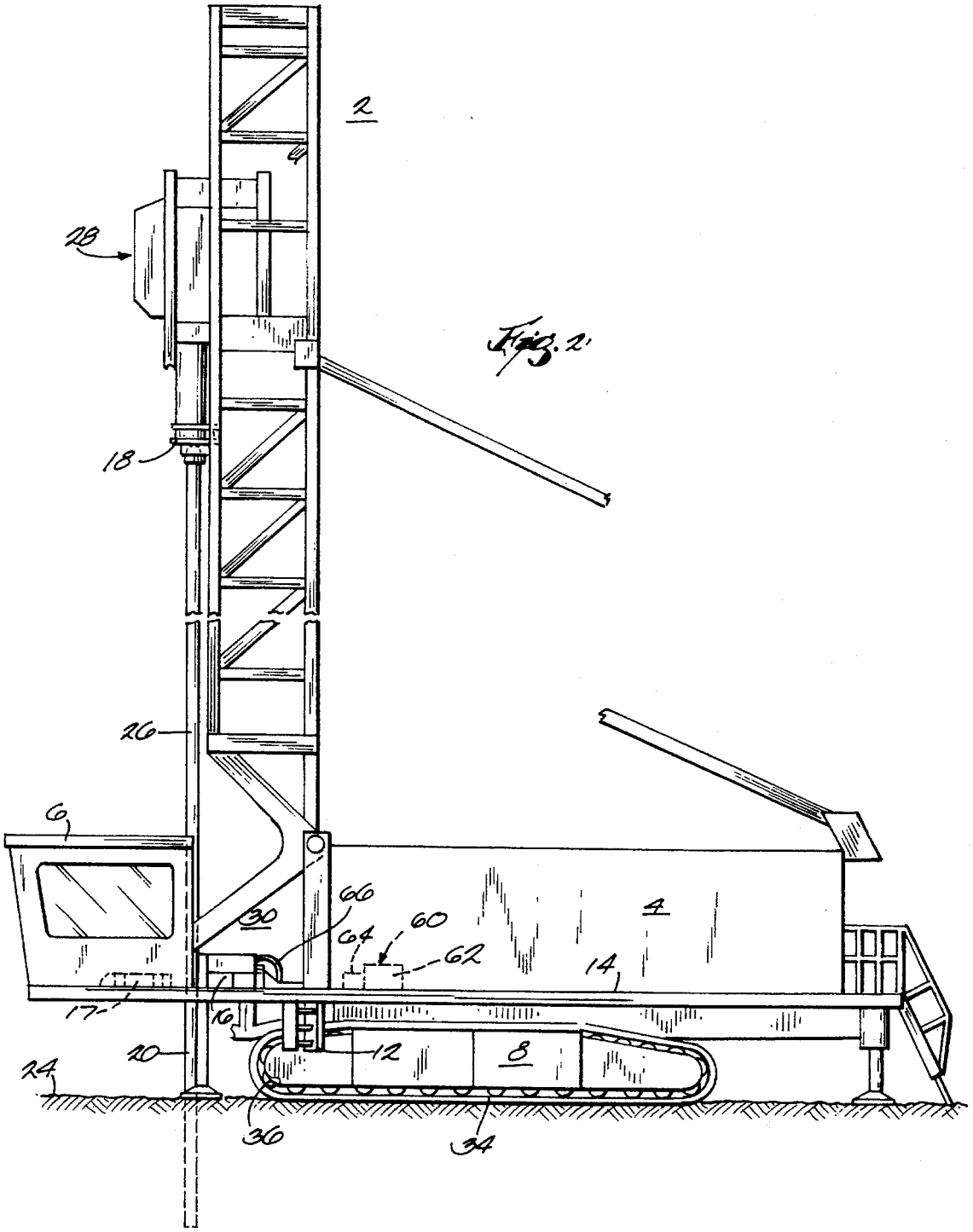
FIG. 2 is a side elevation view, partially broken away, of the blasthole drill shown in FIG. 1.

With reference to FIGS. 1 and 2, a blasthole drill is shown as having a drill tower 2, a machinery house 4, an operator's cab 6, a crawler drive 8, and a ladder 12 providing access to the cab and machinery house. The machinery house and cab are supported on top of a deck 14. The drill tower 2 supports a drill shaft 20 which projects through an opening 10 in the deck 14 and extends downward into the ground 24. The drill shaft 20 includes a threaded section 22, a circumferential recess 21 having slots 104 and 106, and a shoulder 98 having a bottom side 96. A pair of deck wrenches 16 and 17 are mounted on the deck 14 on opposite sides of the opening 10. A thread grease applicator 30 is mounted on the deck wrench 16 and is located entirely laterally of the drill shaft 20 as can be seen in FIG. 2 and also in FIG. 3. A vertically movable carriage 28 is supported on the drill tower 2 and includes a rotary drive head 18 for rotating the drill shaft 20. A second drill shaft 26 is movable up to and held in the drill tower 2 for threaded attachment to drill shaft 20 at the threaded section 22 of the latter shaft.

The rotary drive head 18 clamps a drill shaft extending above ground into the tower and rotates the drill shaft and any other drill shafts connected together to form a string of drill shafts. The carriage 28 moves the head 18 downward to lower the entire drill string into the ground. The drill tower 2 has a horizontal position (not shown) relative to the deck 14 and adjacent to the machinery house 4. The tower 2 is raised and lowered between its vertical and horizontal positions by a tower drive positioned in the machinery house 4. The crawler drive 8 includes crawler track 34 and a tumbler 36 driving the track 34 and in turn driven by a crawler drive motor positioned on the deck 14 within the machinery house. The machinery house 4 also contains additional drill shafts which are transferred into the drill tower 2 when the latter is in its horizontal position adjacent the machinery house. The tower drive, crawler drive motor and the additional drill shafts are well-known and not shown in the drawings. The cab 6 contains control equipment for operation of the blasthole drill by personnel in the cab.

The grease applicator 30 includes a housing 38 having a bottom support plate 40 mounted by bolts 42 to the deck wrench 16 and spaced apart parallel side support plates 41 and 43 affixed by means such as welding to the bottom plate 40. Within the housing 38, the grease applicator 30 has an applicator drive 44 located between the side plates 41 and 43 and fastened by bolts 46 to the support plate 40, a grease applicator head 48, a grease transfer tube 50 connected at one end to the applicator head 48, and a clamp 52 affixing the applicator drive 44 to and supporting the transfer tube 50. A limit switch 54 is mounted on an upright plate 45 affixed to the plate 40 and has a switch arm 56 engaged by a finger 58 extending upward from the clamp 52. The grease applicator 30 also includes a grease supply 60 comprising a grease reservoir 62 located remotely from the grease applicator 30, a grease pump 64 connected to the reservoir 62, and a flexible grease supply line 66 connected between the pump 64 and the transfer tube 50.

Figure 3:
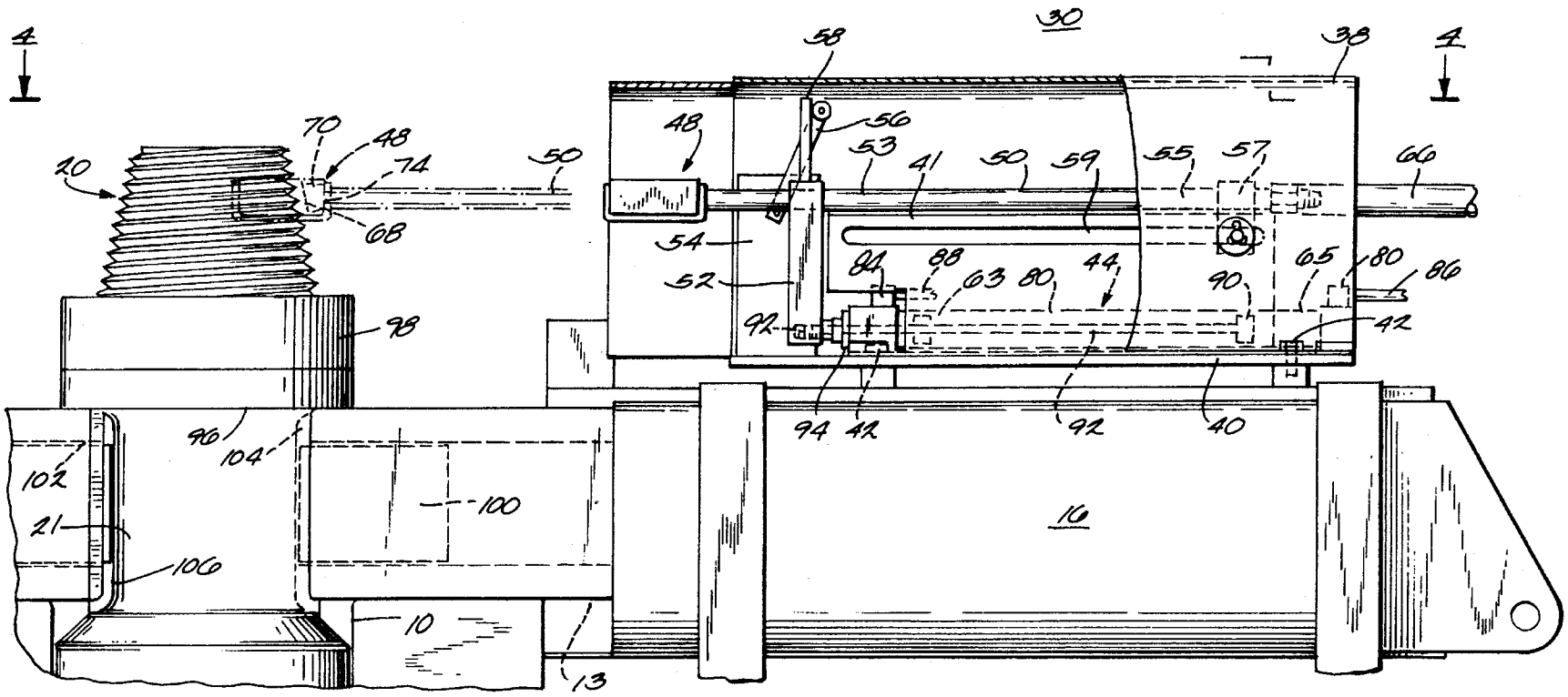
FIG. 3 is a side elevation view, partially in cross-section, of the invention as shown in FIG. 2.
Figure 4:
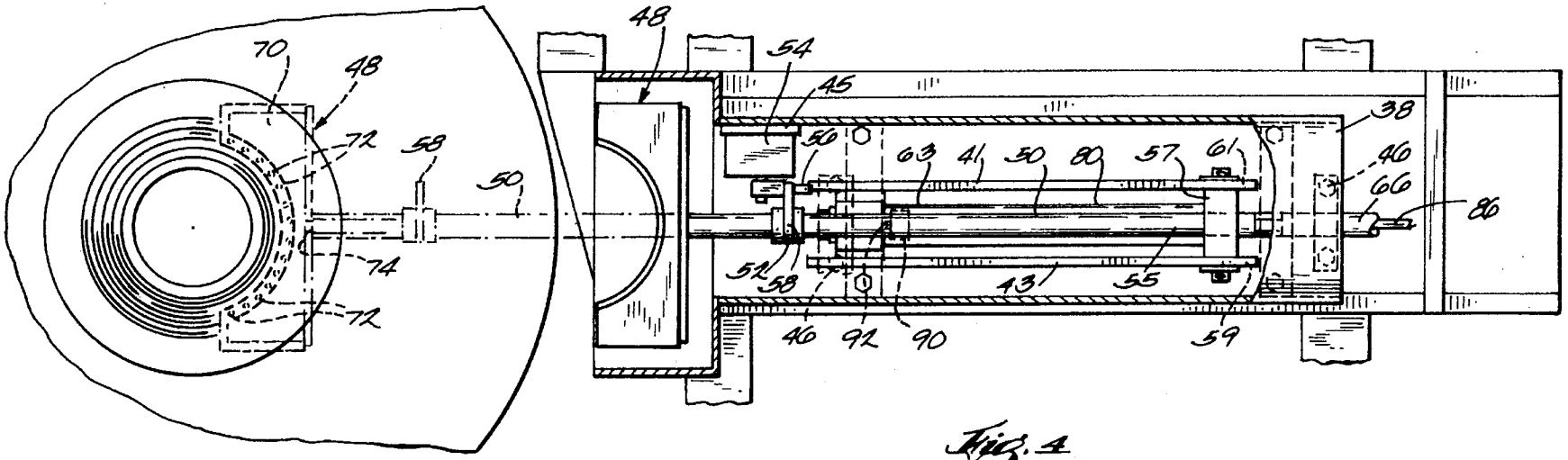
FIG. 4 is a plan view of the invention as shown in FIG. 3.

The grease applicator head 48 has a surface 68 positioned adjacent to the threaded section 22 of the drive shaft 20 when the head 48 is in its extended position as shown in phantom lines in FIG. 3, and a hollow interior 70 connected to the surface 68 through a plurality of openings 72 in the head and connected to the transfer tube 50 through an opening 74 in the head. The surface 68 is arcuate shaped and, in the position of the head shown in phantom lines in FIG. 3, the head 48 and its surface 68 partially surround the threaded section 22.

The grease transfer tube 50 communicates with the grease supply line 66 and is held at its end 53 by the clamp 52. Adjacent the end 55 of the grease tube 50, it is connected to a cross-member 57 retained and slidable within slots 61 and 59 respectively in side plates 41 and 43. The tube 50 is thus movable together with the flexible supply line 66 to permit extending of the applicator head 48 toward the threaded section 22 and retraction of the head 48 away from the threaded section 22. The tube 50 communicates through the opening 74 with the hollow interior 70 of the head so that grease passing through the supply line 66 and the tube 50 flows into the head 48.

The applicator drive 44 is of a hydraulic fluid driven cylindrical type, although a pneumatic cylinder can also be used. The drive 44 comprises a cylinder 80 connected at fittings 82 and 84 to a suitable hydraulic pump source of pressurized hydraulic fluid (not shown). A piston 90 within the cylinder 80 is connected to a rod 92 extending from the ends 94 of the cylinder. The piston 90 is shown at the end 63 of the cylinder 80 when the rod 92 is fully extended from the cylinder, and at the end 65, of the cylinder when the rod 92 is fully retracted within the cylinder. The rod 92 is affixed to the clamp 52 so that the movement of the rod in a direction out of the cylinder 80 or in a direction into the cylinder 80 will result in the respective movement to extend the applicator head 48 along a path toward the threaded section 22 or retract the applicator head 48 along the path in a direction away from the threaded section 22. The movement of the rod 92 into the cylinder to retract the applicator head 48 results when hydraulic fluid is pumped through the hydraulic line 88 into the cylinder 80 and the movement of the rod outward of the cylinder to extend the applicator head 48 toward the threaded section 22 results when hydraulic fluid is pumped into the cylinder through line 86.

In the operation of the drill, when the operator believes that it is necessary to add another drill shaft 26 to a drill shaft such as shaft 20 of a pipe string, he raises the pipe string to a point at which the recess 21 in the shaft 20 is opposite the respective opposed slides 13 and 15 of the deck wrenches 16 and 17. The slides 13 and 15 are then extended into engagement with the bottom side 96 of the shoulder 98 of the shaft 20. Shaft 20 is thus supported at a height position at which the rotary drive head 18 can be unthreaded from the threaded section 22 of the shaft and another shaft 26 can be threaded onto the shaft 20. The rotary drive head 18 is then operated to rotate in a counterclockwise direction and thereby unthread itself from the threaded section 22 of the shaft 20. The carriage 28 then moves the drive head upward from the shaft 20. During the rotation of the drive head to unthread from the shaft 20, the shaft 20 is held from turning in a counterclockwise direction by the engagement of the pawls 100 and 102 against the sides of the slots 104 and 106 in the shaft 20.

Upon the upward movement of the rotary drive head 18, the grease applicator 30 may be operated to apply grease to the threaded section 22 of the shaft 20. To begin the application of grease, the operator engages a touch control which causes hydraulic fluid to be pumped into the cylinder 80 through the line 86 to thereby extend the piston 90, rod 92 and clamp 52 in the direction of the drill shaft 20. The movement of the clamp 52 moves the grease transfer tube 50 and the applicator head 48 toward the threaded section 22 of the shaft 20 until the maximum outward travel of the rod 92 is reached. At this rod travel extension, the applicator head 48 will be positioned adjacent to the threaded section 22.

Simultaneously with the pumping of hydraulic fluid through the line 86 to move the piston 90 outward, a timing operation is begun which is preset for the time required for the piston 90 and rod 92 to move outward to their travel location at which the applicator head 48 reaches its position adjacent to the threaded section 22. At the end of the preset time, the grease pump 64 is operated for a preset length of time sufficient to pump a predetermined volume of grease from the reservoir 62 through the applicator head 48 onto the threaded section 22. At the end of the time period during which the grease pump 64 operates, the pressurized hydraulic fluid in the line 86 is released and fluid is pumped into the end 63 of the cylinder 80 through the line 88 so that the piston 90 is moved in the direction of the cylinder. Thereby the rod 92, clamp 52 and the applicator head 48 are moved away from the threaded section 22 and back into the housing 38. When the clamp 52 returns to its position within the housing, the finger 58 extending from the clamp 52 engages the switch arm 56 of the limit switch 54 to provide a switching action indicating the return of the applicator into the housing and the completion of the greasing of the threaded section 22. If the switching action of the limit switch does not take place within a preset time limit following the release of the pressurized hydraulic fluid in the line 86, a fault signal will be provided to the operator indicating that the applicator head 48 may be obstructing the connecting of the next drill shaft 26 to the drill shaft 20. The fault signal may also be used to terminate supply of pressurized hydraulic fluid to the end 63 of the cylinder 80. Following the return of the applicator head 48 into the housing 38, the operator moves the carriage 28 and drive head 18 downward to move the drill shaft 26 into engagement with the thread section 22. The drive head 18 is then rotated to threaded the shaft 26 in a clockwise direction onto the threaded section 22 of the drill shaft 20 to thereby connect the drill shaft 26 to the shaft 20. The operator then retracts the deck wrench slides 13 and 15 from the recesses 21 in the shaft 20 and lowers the drill shafts 20 and 26 and any additional drill shafts attached to shaft 20 which comprise the entire drill string downward to resume drilling.

The operator may initiate the grease application sequence as described above prior to positioning the next drill shaft 26 above the threaded section 22 of the shaft 20. In this mode of operation, the grease application process proceeds automatically while the operator is positioning the next shaft 26 above the shaft 20 so that no time is wasted waiting for the completion of the grease application step. However, this method of applying the grease results in a time delay between the grease application and the threading of the drill shaft 26 onto the drill shaft 20. This delay provides an opportunity for dirt to be blown onto the greased threaded section 22, when working conditions are particularly dirty, so that the benefit of the lubrication may be lost. An alternative method of applying the grease to the threaded section 22 is for the operator to wait until the next drill shaft 26 is in a position ready to be threaded on to the shaft 20 and then initiate the operation of the grease application. This method will take more time but will minimize the amount of dirt that adheres to the threaded section 22 prior to attaching the next drill shaft 26.

It will be understood that the foregoing description of the present invention is for purposes of illustration only and that the invention is susceptible to a number of modifications or changes, none of which entail any departure from the spirit and scope of the present invention as defined in the hereto appended claims.

What is claimed is:

1. A grease applicator for use on a drill supporting at least one drill shaft including a threaded section, the drill including a vertically movable carriage for raising and lowering the drill shaft and a rotary drive for rotating the drill shaft, comprising:

a grease applicator head having a semicircular shaped surface and a position adjacent the threaded section of the drill shaft at which said surface surrounds a portion of the threaded section of the drill shaft;

drive means comprising cylinder means located only laterally of the drill shaft and connected to the applicator head for extending the applicator head to and retracting the applicator head from said position, the applicator head and cylinder means moving in the same direction during the extending and retracting movement of the applicator head; and means connected to the applicator head for propelling grease through the applicator head into engagement with the threaded section.

2. The grease applicator according to claim 1 wherein:

the applicator head has an interior connected to the grease propelling means; and the surface of the applicator head has a plurality of spaced apart grease passages connected to said interior whereby grease propelled through the applicator head is distributed along said surface as it engages the threaded section.

3. The grease applicator according to claim 1 further comprising:

a tube connected to the grease propelling means and applicator head for transmitting grease to the applicator head; and wherein the drive means is affixed to the tube.

4. The grease applicator according to claim 3 wherein the grease propelling means includes a grease supply reservoir located remotely from the tube and applicator head.

5. A method of applying grease to a threaded section of a drill shaft comprising the steps of:

vertically positioning said threaded section in the path of movement of a grease applicator head;

extending the grease applicator head along said path toward the threaded section;

surrounding not more than one-half of the circumference of the threaded section with a surface of the grease applicator head adjacent to the threaded section;

propelling grease through openings in and distributed along the surface of the grease applicator head to apply and distribute grease on the threaded section; and retracting the grease applicator head away from the threaded section along said path.

6. The method according to claim 5 wherein:

the step of extending the grease applicator head includes moving the applicator head along a straight-line path to a position adjacent the threaded section.

7. A grease applicator for use on a drill supporting at least one drill shaft including a threaded section, the drill including a vertically movable carriage for raising and lowering the drill shaft and a rotary drive for rotating the drill shaft, comprising:

applicator means having a position adjacent to and surrounding a portion of the threaded section of the drill shaft located only laterally of the drill shaft for applying grease to the threaded section;

means located only laterally of the drill shaft for propelling grease through the applicator means into engagement with the threaded section; and drive means connected to the applicator means and located only laterally of the drill shaft for extending the applicator means to and retracting the applicator means from said position.

8. A grease applicator for use on a drill supporting at least one drill shaft including a threaded section, the drill including a vertically movable carriage for raising and lowering the drill shaft and a rotary drive for rotating the drill shaft, comprising:

a grease applicator head having a grease applicating position adjacent the threaded section and a retracted position spaced from the threaded section, the grease applicator head being movable along a path between said positions only laterally of said at least one drill shaft;

a grease supply tube connected to the grease applicator head for transmitting grease to the latter;

guide means affixed to the grease supply tube for guiding and supporting the latter to move along said path with the grease applicator head; and drive means connected to the grease supply tube for providing movement for the applicator head and supply tube along said path.

9. The grease applicator according to claim 8 wherein the applicator head, supply tube and drive means move parallel to each other.

10. The grease applicator according to claim 8 wherein the threaded section has a circumference and the applicator head has an arcuate surface facing the threaded section at said applicating position, the arcuate surface having a length not more than one-half of the circumference of the threaded section faced by the arcuate surface.

* * * * *